US008011284B2

(12) United States Patent
Rinaldo

(10) Patent No.: US 8,011,284 B2
(45) Date of Patent: Sep. 6, 2011

(54) DIE-CUTTING DEVICE FOR PERFORMING SLOTS PERPENDICULAR TO THE FEEDING DIRECTION OF BOX-FORMING PAPERBOARD SHEETS

(76) Inventor: Benzoni Rinaldo, Lissone (IT)

( * ) Notice: Subject to any disclaimer, the term of this patent is extended or adjusted under 35 U.S.C. 154(b) by 475 days.

(21) Appl. No.: 10/358,841

(22) Filed: Feb. 5, 2003

(65) Prior Publication Data

US 2003/0150313 A1 Aug. 14, 2003

(30) Foreign Application Priority Data

Feb. 12, 2002 (IT) ..... MI2002A0273

(51) Int. Cl.
*B26D 7/00* (2006.01)

(52) U.S. Cl. ..... 83/650; 83/673; 83/559; 83/498

(58) Field of Classification Search ..... 83/673–676, 83/492, 493, 494, 498, 499, 299, 331, 559, 83/650

See application file for complete search history.

(56) References Cited

U.S. PATENT DOCUMENTS

| | | | | | |
|---|---|---|---|---|---|
| 3,272,042 | A * | 9/1966 | Haas | 83/864 |
| 3,651,723 | A * | 3/1972 | Gallagher et al. | 83/864 |
| 4,116,098 | A * | 9/1978 | Suzuki et al. | 83/425.4 |
| 4,215,609 | A * | 8/1980 | Coburn et al. | 83/492 |
| 4,265,152 | A * | 5/1981 | Corradi | 83/106 |
| 4,319,506 | A * | 3/1982 | Warren et al. | 83/347 |
| 4,515,052 | A * | 5/1985 | Flaum | 83/479 |
| 4,638,701 | A * | 1/1987 | Oberlander et al. | 83/490 |
| 4,934,234 | A * | 6/1990 | Cavagna | 83/498 |
| 5,181,899 | A * | 1/1993 | Hill et al. | 493/34 |
| RE35,345 | E * | 10/1996 | Adami | 493/355 |
| 5,647,277 | A * | 7/1997 | DeVito | 101/226 |
| 5,918,519 | A * | 7/1999 | Schnabel et al. | 83/428 |
| 6,652,434 | B2 * | 11/2003 | Benzoni | 493/59 |

* cited by examiner

*Primary Examiner* — Boyer D Ashley
*Assistant Examiner* — Omar Flores-Sánchez
(74) *Attorney, Agent, or Firm* — Hedman & Costigan, P.C.; James V. Costigan

(57) ABSTRACT

A die-cutting device is herein disclosed for performing slots perpendicular to the feeding direction of paperboard sheets used for making boxes, which is mounted on a supporting framework which can be driven in a cross direction with respect to the longitudinal feeding direction of the paperboard sheets.

3 Claims, 8 Drawing Sheets

DIE-CUTTING DEVICE FOR PERFORMING SLOTS PERPENDICULAR TO THE FEEDING DIRECTION OF BOX-FORMING PAPERBOARD SHEETS

BACKGROUND OF THE INVENTION

The present invention relates to an improved paperboard sheet die-cutting device.

A lot of paperboard sheet die-cutting devices have been already designed, for performing the cutting operations on paperboard sheets, for making paperboard boxes and the like.

However, prior paperboard sheet die-cutting devices are affected by several drawbacks, the main of which is that they are not operatively flexible and, moreover, are rather complex construction-wise.

SUMMARY OF THE INVENTION

Accordingly, the aim of the present invention is to overcome the above mentioned drawbacks of prior paperboard sheet die-cutting devices, by providing a novel improved die-cutting device specifically designed to be directly applied at the outlet of a paperboard sheet slotting machine.

Within the scope of the above mentioned aim, a main object of the present invention is to provide such a paperboard sheet die-cutting device which is very flexible in operation and very simple construction-wise.

Another object of the present invention is to provide such an improved paperboard sheet die-cutting device which allows to make paperboard boxes with a very high production yield and which, in particular, comprises a plurality of cross rollers, specifically designed for performing, at subsequent operating times, a first and third cross slots, one of said roller supporting cross blades or knives for performing, at different operating times, a second and fourth cross slots.

Yet another object of the present invention is to provide such a paperboard sheet die-cutting device which comprises moreover a trimming circular knife or blade, which can be driven toward and away with respect to the paperboard sheet, the driving movement of said trimming knife being controlled by a pneumatic piston, designed for vertically swinging a lever supporting the rotary shafts of the trimming knife or blade, for driving it at a lower position and locking it at a raised position.

Yet another object of the present invention is to provide such a die-cutting device comprising a plurality of crumbling cross blades allowing to crumble the excess paperboard material exceeding a rated paperboard amount as required for making a lot of different size boxes.

Yet another object of the present invention is to provide such a paperboard sheet die-cutting device in which the trimming knife is directly operated by the paperboard sheet advancing or feeding movement.

Yet another object of the present invention is to provide such a paperboard sheet die-cutting device allowing to easily and quickly replace the cutting blades thereof, by a pre-shaped die-cutting unit having wood shells bearing a plurality of contoured blades.

Yet another object of the present invention is to provide such a paperboard sheet die-cutting device including two die-cutting assemblies, cooperating with one another to provide a very quick and accurate cutting operation with a consequent very high die-cutting efficiency.

According to one aspect of the present invention, the above mentioned aim and objects, as well as yet other objects, which will become more apparent hereinafter, are achieved by a die-cutting device for performing slots perpendicular to the feeding direction of box-forming paperboard sheets having the features of the main claim.

Further advantageous features of the device according to the invention are defined in the dependent claims.

BRIEF DESCRIPTION OF THE DRAWINGS

The above mentioned and other features of the die-cutting device according to the present invention will become more apparent hereinafter from the following detailed disclosure of a preferred, though not exclusive, embodiment thereof, with reference to the figures of the accompanying drawings, where:

FIG. 4 further schematically shows cross-blade pairs, including cutting blades for performing two cross slots, with respect to be paperboard sheet feeding or advancing direction, this figure further showing a side trimming knife, which is upward and downward operated through a lever by a pneumatic piston;

DESCRIPTION OF THE PREFERRED EMBODIMENTS

Figure 1:
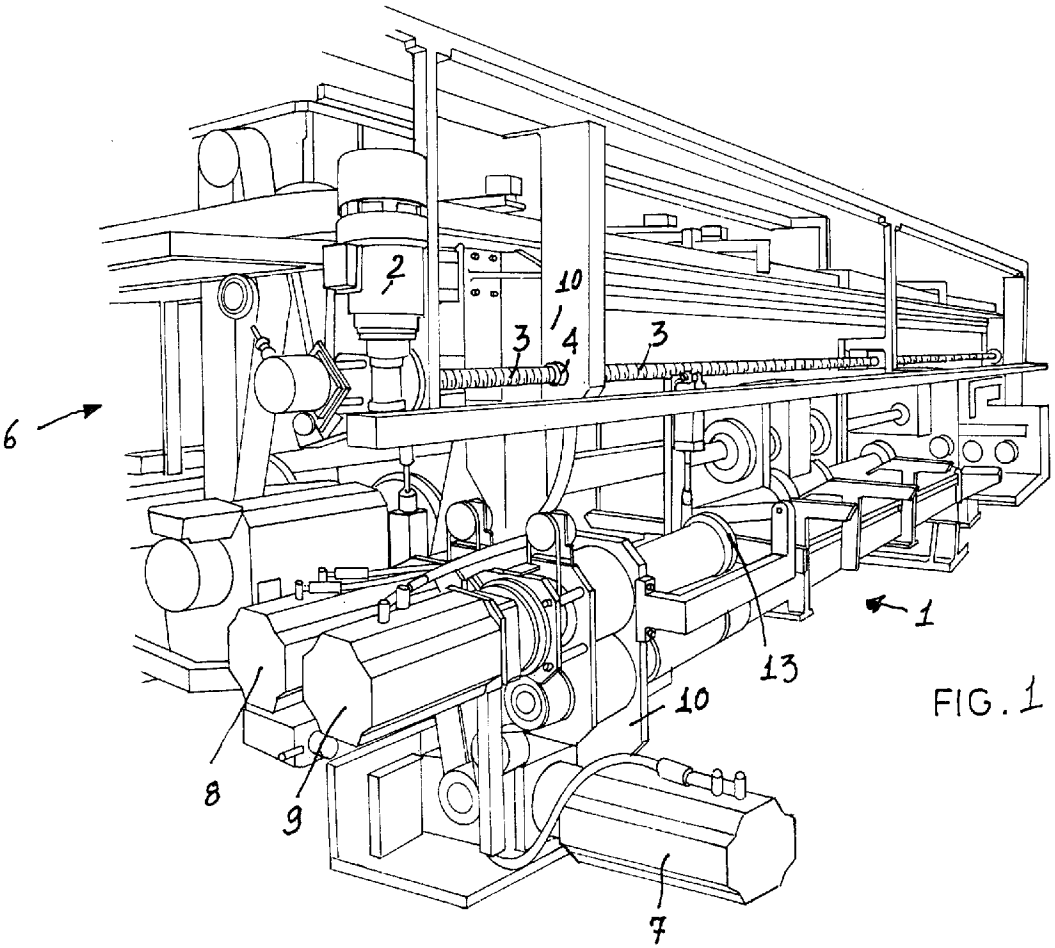
FIG. 1 is a side perspective view illustrating the paperboard sheet die-cutting device according to the present invention, applied to a slotting machine.
Figure 2:
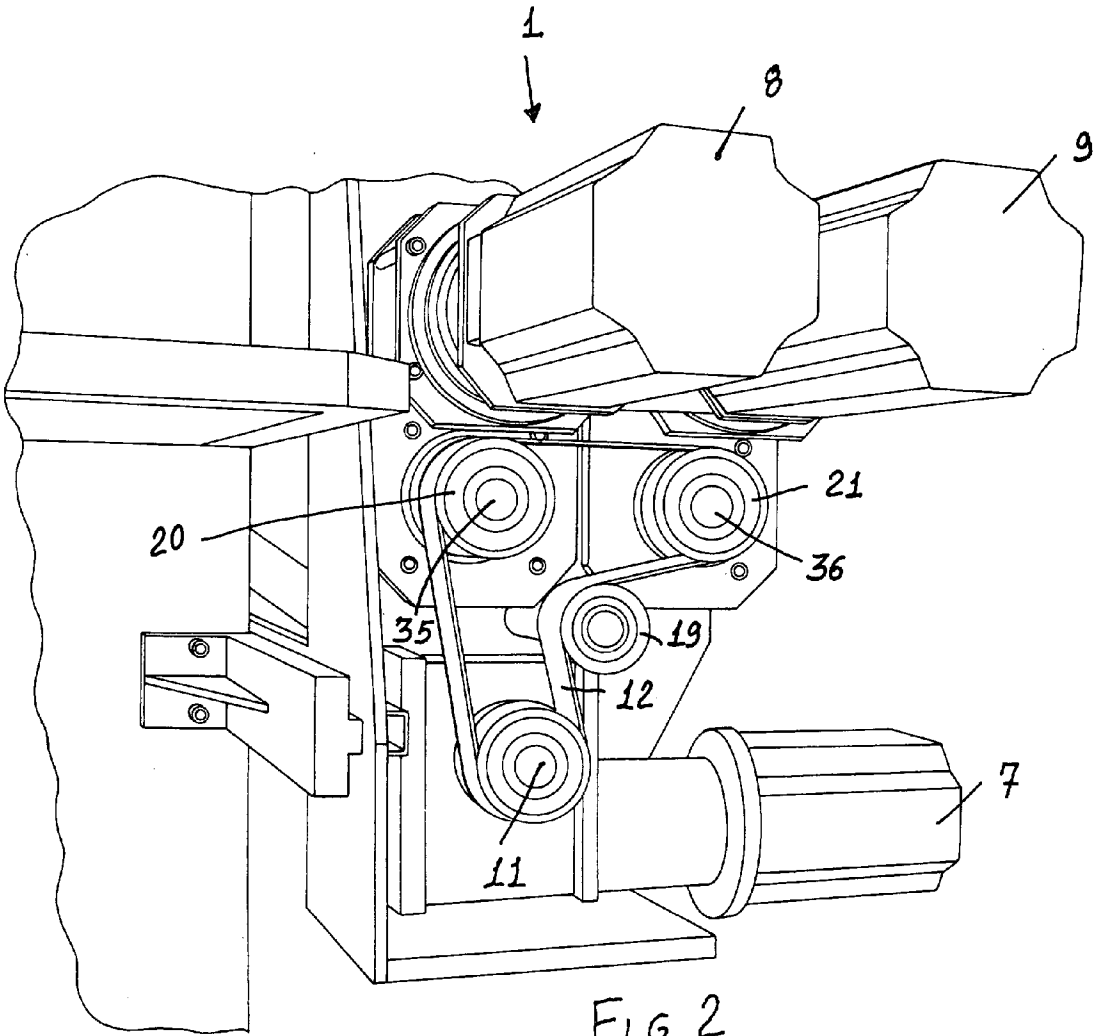
FIG. 2 is a further detailed side perspective view illustrating the paperboard sheet die-cutting device according to the invention.

With reference to the number references of the figures of the accompanying drawings, the improved paperboard sheet die-cutting device according to the present invention, which has been generally indicated by the reference number 1, is provided for mounting at the outlet of the paperboard sheets 60 being processed by a paperboard sheet slotting machine 6.

More specifically, with reference to FIGS. 1 to 5, the die-cutting device according to the invention is mounted on a supporting framework 10 of the die-cutting device 1, which can be transversely driven with respect to the longitudinal feeding or advancing direction of the paperboard sheet 60.

This movement, in particular, is controlled by a gear-motor unit 2 also mounted on said supporting framework 10 and which rotatively drives a worm screw 3 engaging with a female thread of a bush 4 also applied to the supporting framework 10 of the die-cutting device 1.

Figure 3:
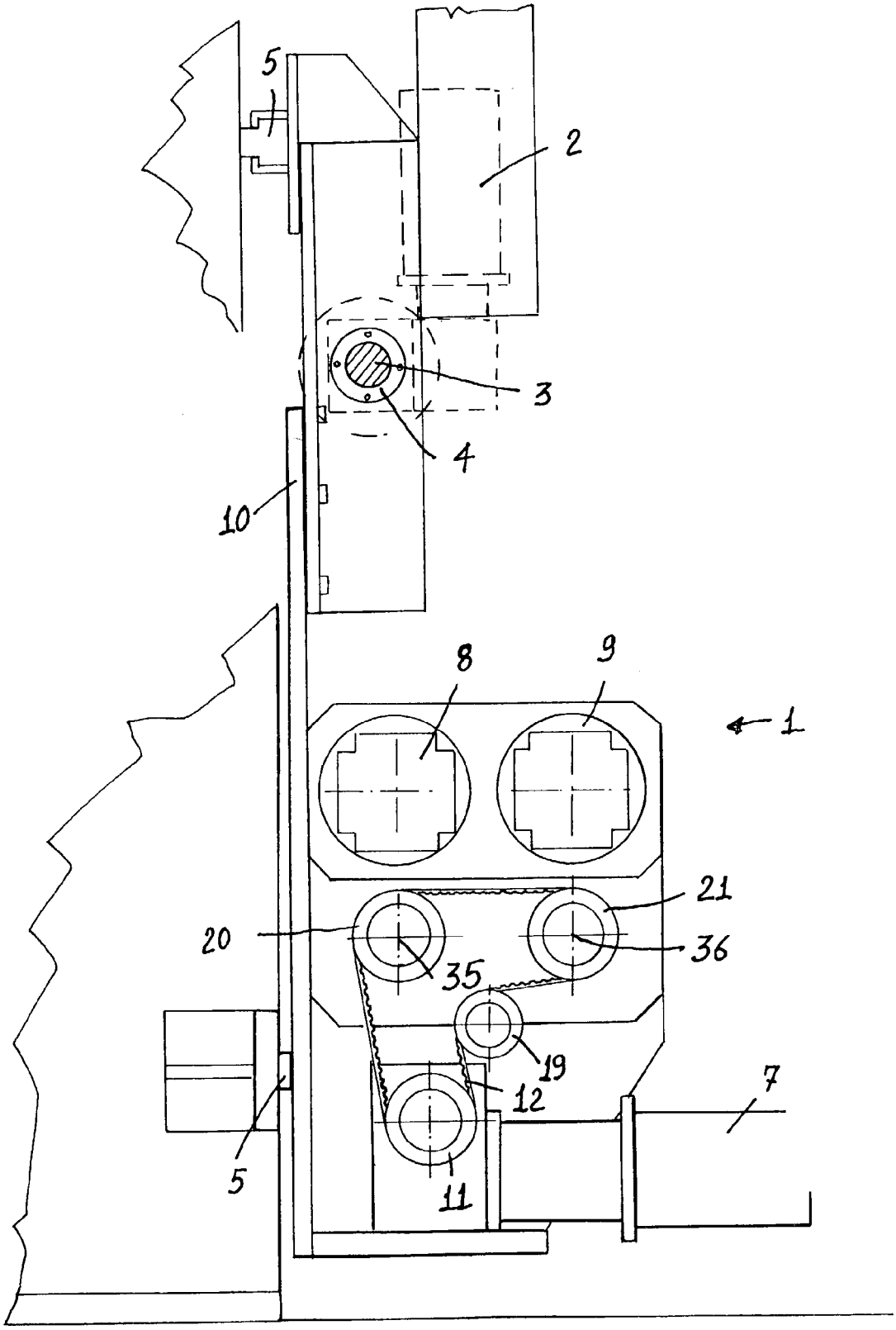
FIG. 3 illustrates a side view of the die-cutting device, and clearly show the supporting framework of said device, applied to a paperboard sheet slotting machine.
Figure 4:
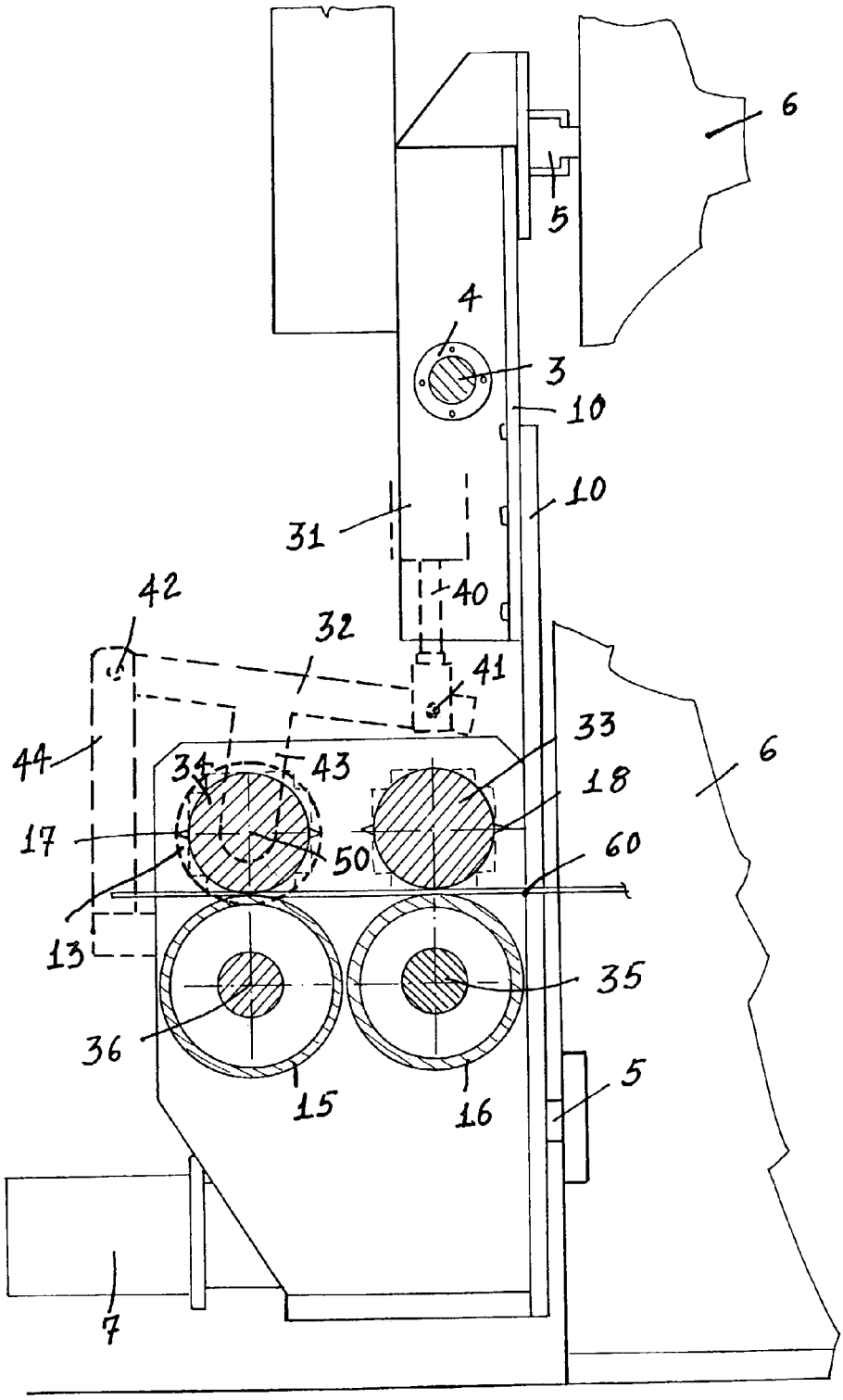
FIG. 4 shows the supporting framework of the die-cutting device of the invention, which framework is driven by a worm screw engaging with a female thread formed on a bush applied to the supporting framework.
Figure 5:
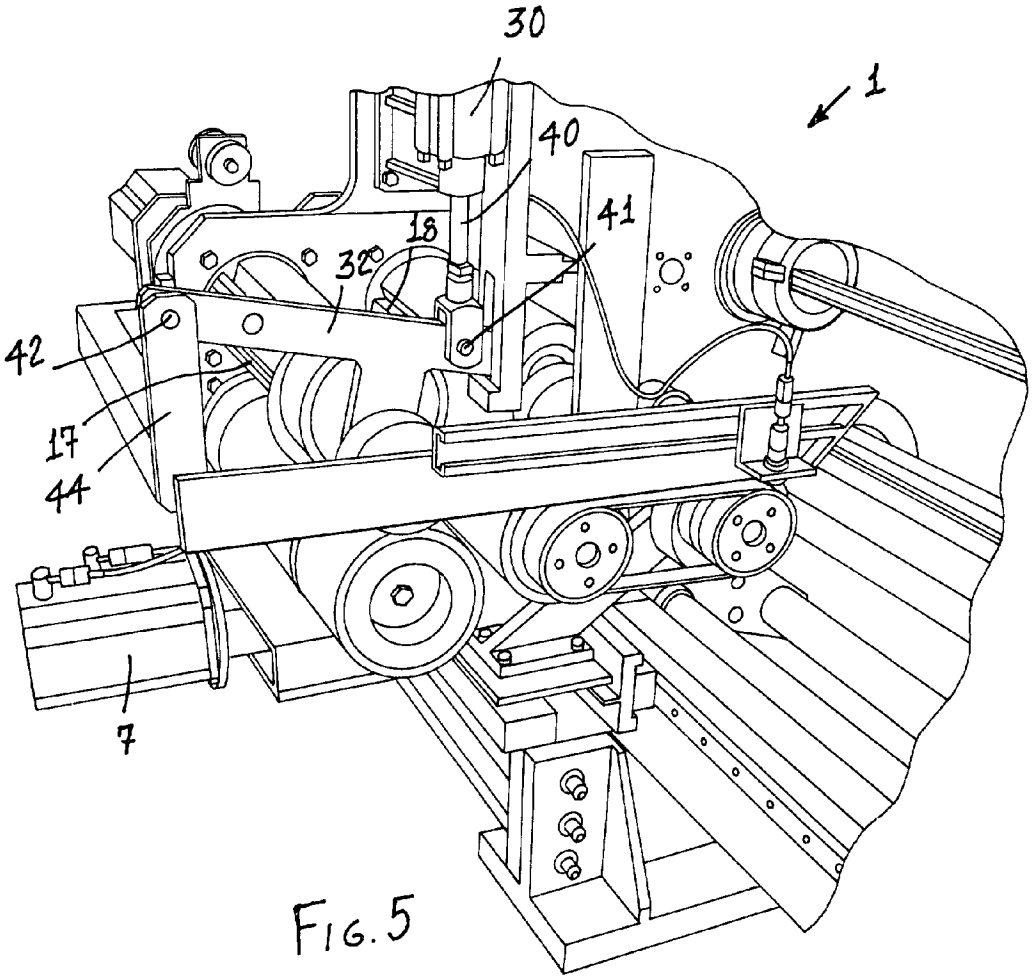
FIG. 5 is a top side perspective view of the above assembly, in which is shown the piston for raising the trimming knife and the two-shaft assembly including two shafts each supporting a pair of cross blades, for performing cross slots, with respect to the paperboard sheet feeding or advancing direction.

As shown in FIGS. 3 and 4, said supporting framework 10 is slidably supported on cross slides 5 applied to the frame of the slotting machine 6 to which the subject the die-cutting device is also coupled.

Alternatively, the die-cutting device 1 could comprise an independent bearing construction.

The device 1 comprises brushless motor 7, 8 and 9.

A first of said motors drives a toothed pulley 11, thereon is entrained a drive belt 12, controlled by a belt tension element 19 and a pair of pulleys 20 and 21 rigid with shafts 35 and 36.

The belt 12, in turn, rotatively drives said shafts 35 and 36 thereon are idly supported the polyurethane ring elements 15 and 16 operating as abutment elements for the cutting operation provided by the cross blades 17 and 18 of the die-cutting device 1.

Said ring elements 15 and 16 can be idly rotatively driven, so as to allow the cross blades 17 and 18 to operate at different cutting positions, thereby preventing the abutment rings 15 and 16 from being quickly worn.

The first brushless motor 7 rotatively drives the bottom ring elements or rollers 15 and 16, the operating speed of which is synchronized with the outlet speed of the paperboard sheet to be processed.

Each of the other two brushless motor 8 and 9 drives the advancing or feeding movement of two shafts 33 and 34 supporting a pair of cross blades 17 and 18, which are designed for performing two cross slots, with respect to the paperboard sheet feeding direction.

Alternatively, said two cross blades 17 and 18 can be replaced by a pre-shaped die-cutting unit, having wood shell means bearing the contoured blades.

In this connection, it is to be pointed out that the die-cutting devices or assemblies 1, mounted on the slotting machine, are provided in a number of two.

More specifically, they are mounted or coupled to the side portions of the slotting machine frame.

Figure 7:
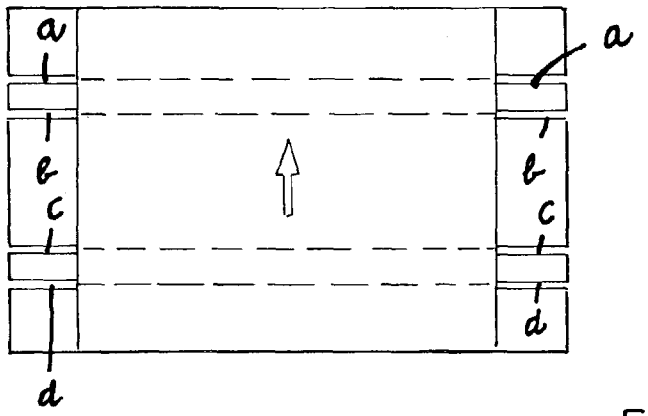
FIGS. 7, 8 and 9 show possible operating steps which can be carried out on flat paperboard sheets to be used for making packaging boxes.

In the exemplary embodiment shown in FIG. 7, one of the rollers including the cross knives or blades, performs, at subsequent operating times, the first and third slotting operation, a and c, whereas the other two knives, applied on the second roller, perform, at different times too, the second and fourth cross slots b and d.

Figure 8:
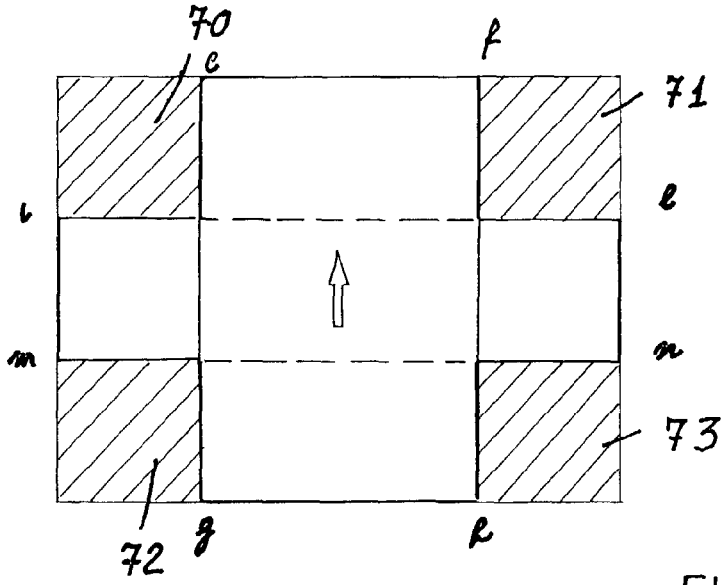

FIG. 8 shows a further working example which can be carried out by using a pair of die-cutting devices, in cooperation with a slotting assembly longitudinally extending with respect to the paperboard sheet feeding direction.

This figure, in particular, shows four longitudinal cuts e, f, g, h performed by a longitudinal slotting assembly, and four cross cuts i, l, m, n performed by two die-cutting devices according to the invention.

Thus, it is possible to automatically trim or cut away the paperboard portions which has been shown in the drawings by the dashed lines and indicated by the reference numbers 70, 71, 72 and 73.

Figure 9:
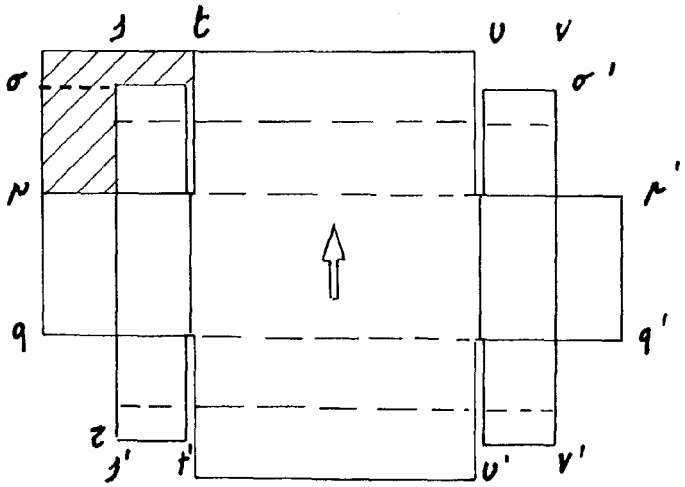

FIG. 9 shows another possible working example which can be carried out by the die-cutting device according to the invention.

More specifically, this figure shows a paperboard sheet cut by two series of cross cuts o, p, q, r and o', p', q', r' and two series of longitudinal cuts s, t, u, v and s', t', u', v'.

The cross cuts are provided by cutting blades of different lengths.

In particular, two shorter blades, applied on a supporting shaft, performs the cuts p, p' and q, q', whereas two other longer blades perform the cross cuts o, r and o', r'.

The die-cutting device 1 according to the invention is moreover provided with a circular trimming knife 13 which can be driven toward and away with respect to the paperboard sheet.

This circular trimming knife 13 is driven by pneumatic piston 31, designed for vertically swinging, through a shaft 40 and a pin 41, a lever 32 supporting the rotary shaft 50 of the trimming knife 13.

Figure 6:
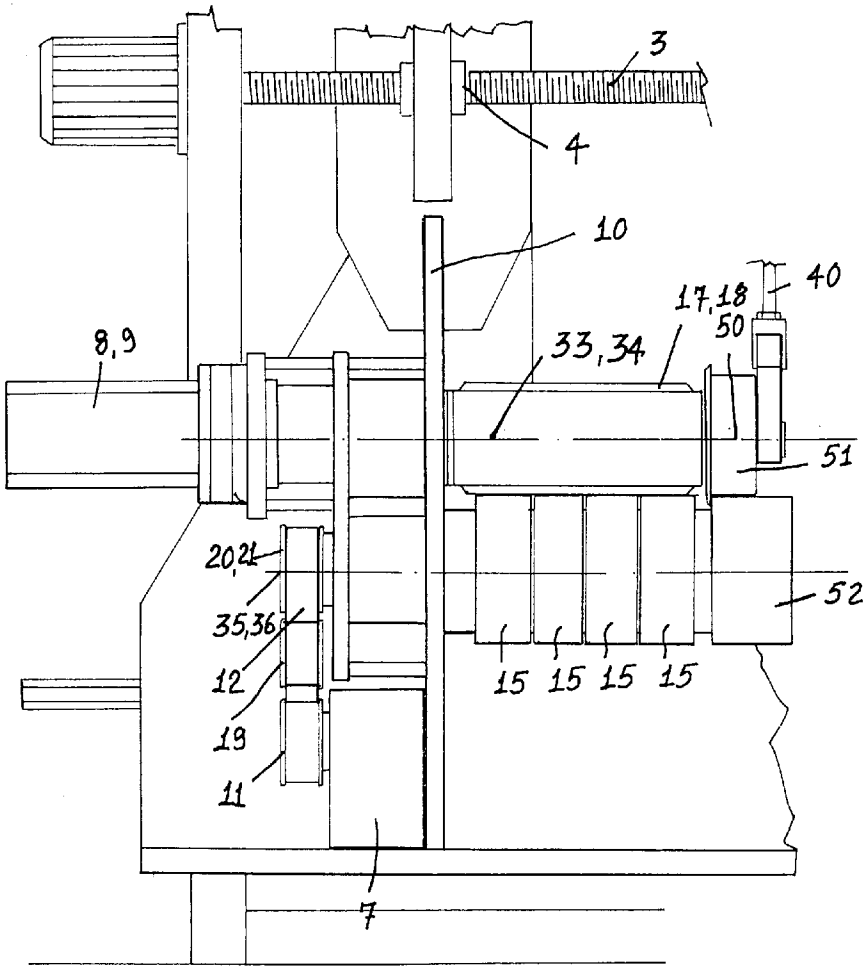
FIG. 6 shows a side front view of the die-cutting device according to the invention.

As is shown in FIG. 6, during its trimming simple operation, the knife 13 can be idly rotatively driven about the shaft 50, the axis of which is cross-wise directed with respect to the paperboard sheet feeding direction.

It is further possible to use the cross blades 17 and 18 for crumbling the paperboard material portion exceeding the rated size.

The trimming blade 13 is rotatively driven by the paperboard sheet 60 feeding movement, which drives the counter-pressing top roller 51 rigid with said knife 13.

FIGS. 7, 8 and 9 show several operating steps which can be carried out by the die-cutting device according to the invention, i.e. a lot of die-cutting operations performed in a cross direction with respect to the paperboard sheet feeding movement and further longitudinal trimming operations which can be performed by the subject machine.

Figure 10:
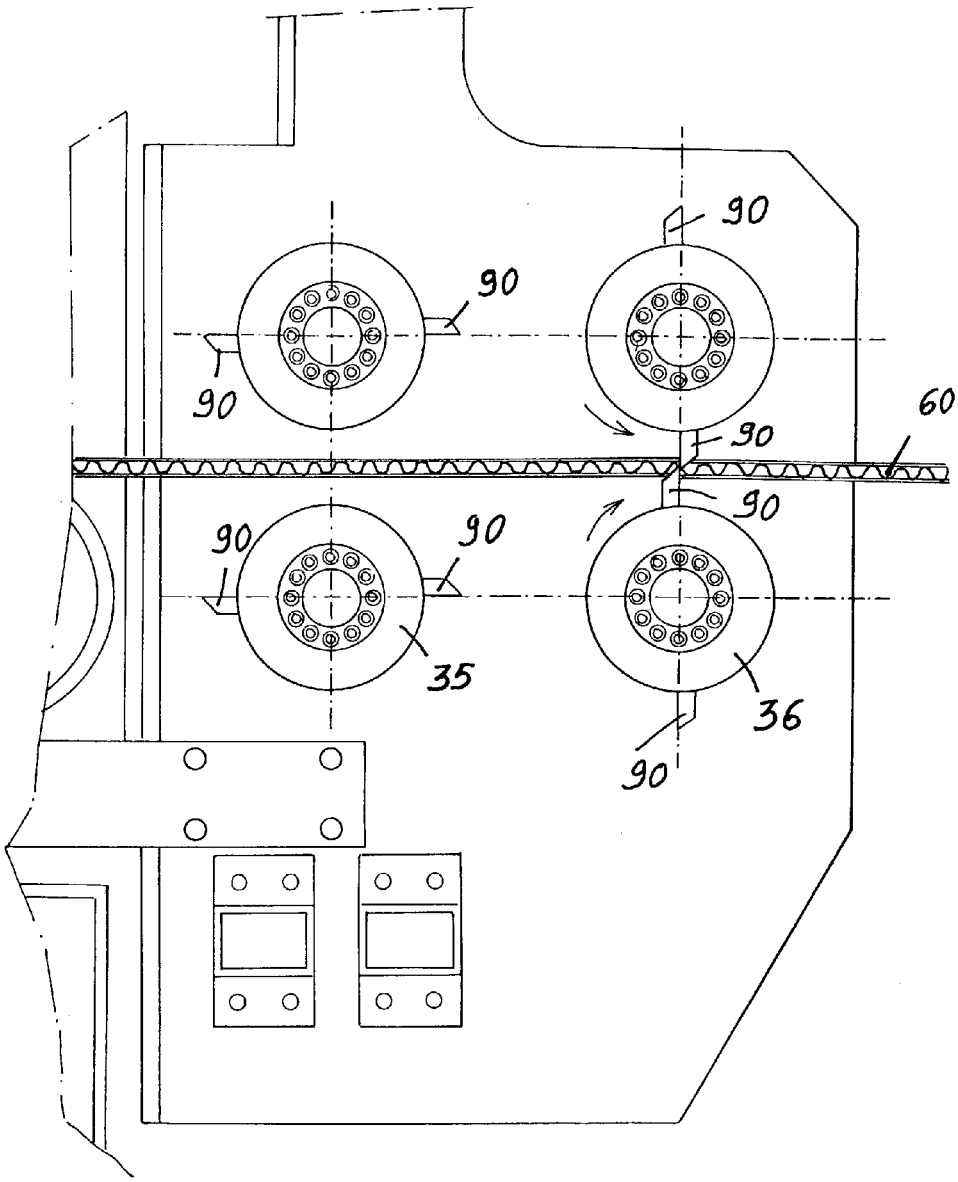
FIG. 10 illustrates a side view of a modified embodiment of the die-cutting device according to the invention.

FIG. 10 shows a modified embodiment of the die-cutting device, designed for performing cross cuts instead of cross slots.

In this case, the shafts 35 and 36, which are similar to those shown in FIG. 4, instead of supporting the ring elements 15 and 16 and being driven by the motor 7, support transversal blades 90 and are rotatively driven, in a mechanically synchronized manner, together with the shafts 33 driven by the motors 8 and 9.

Also in this case, the paperboard sheet 60 is evenly driven by the roller 52 and related idle counter-pressing roller, coupled to the motor 7.

While the die-cutting device according to the present invention has been hereinabove illustrated with reference to a preferred embodiment thereof, it should be apparent that it is susceptible to several modifications and variations, all of which will enter the scope of the invention.

The invention claimed is:

1. A paperboard die-cutting device for making paperboard boxes which is adapted for connection as an independent operating unit to an output of a paperboard sheet slotting machine having a slotting machine frame and feeding paperboard slotted sheets in a longitudinally feeding direction, wherein said die-cutting device is mounted on a cross-sliding supporting framework independent from said slotting machine frame, and which is transversely slidingly driven by a gear motor unit also mounted on said supporting framework and cross-sliding on cross slides applied to said slotting machine frame and cross arranged with respect to said longitudinal feeding direction, said gear motor unit rotatively driving a gear motor unit worm screw engaging with a female thread of a bush supported by said supporting framework, said supporting framework further supporting two first driven shafts supporting a pair of roller supported cross-cutting means for making, in said paperboard sheets, two cross-slots, and two second driven shafts each idly rotatively supporting an abutment polyurethane ring element allowing said cross-cutting means to operate at different cutting portions to prevent said abutment ring elements from being quickly worn, and three motors, a first of said three motors driving said two second driven shafts, and the second and third motors driving said two first driven shafts.

2. A paperboard die-cutting device for making paperboard boxes which is adapted for connection as an independent operating unit to an output of a paperboard sheet slotting machine having a slotting machine frame and feeding paperboard slotted sheets in a longitudinally feeding direction, wherein said die-cutting device is mounted on a cross-sliding supporting framework, which is transversely slidingly driven by a gear motor unit also mounted on said supporting framework and cross-sliding on cross slides applied to said slotting machine frame and cross arranged with respect to said longitudinal feeding direction, said gear motor unit rotatively driving a gear motor unit worm screw engaging with a female thread of a bush supported by said supporting framework, said framework further supporting two first driven shafts supporting a pair of roller supported cross-cutting means for making, in said paperboard sheets, two cross-slots, and two second driven shafts each idly rotatively supporting an abutment polyurethane ring element allowing said cross-cutting means to operate at different cutting portions to prevent said abutment ring elements from being quickly worn, and three brushless motors, a first of said three brushless motors driving said two second driven shafts, and the second and third motors driving said two first driven shafts, and wherein said two second driven shafts are driven by said first motor through a toothed pulley thereon is entrained a drive belt and by a pair of two further pulleys that are rigid with said two second driven shafts, thereby causing said polyurethane ring elements to operate with a speed synchronized with a feeding speed of said paperboard sheets, said cross-cutting means comprising two cross-cutting blades both driven by said first driven shafts.

3. A paperboard slotting machine including a paperboard slotting machine frame having a first side frame portion and a second side frame portion, wherein either one or both said side portions are coupled to a paperboard die cutting device according to claim 1.

* * * * *